United States Patent [19]

Wills

[11] 4,307,457

[45] Dec. 22, 1981

[54] SLAMMING-RESISTANT SONAR DOME CANOE

[75] Inventor: Ronald B. Wills, Niagara on the Lake, Canada

[73] Assignee: Fleet Industries, Ontario, Canada

[21] Appl. No.: 118,773

[22] Filed: Feb. 5, 1980

[30] Foreign Application Priority Data

Feb. 5, 1979 [CA] Canada ..... 320858

[51] Int. Cl.[3] ..... H04R 1/02; B63B 45/08

[52] U.S. Cl. ..... 367/173; 114/270; 181/198

[58] Field of Search ..... 114/67 R, 312, 322, 114/341, 270; 367/141, 165, 173, 188; 181/0.5, 198

[56] References Cited

U.S. PATENT DOCUMENTS 2,417,830 3/1947 Keller ..... 367/165

2,672,945 3/1954 Harris et al. ..... 367/173

*Primary Examiner*—Richard A. Farley

*Attorney, Agent, or Firm*—Birch, Stewart, Kolasch and Birch

[57] ABSTRACT

A slamming-resistant sonar dome canoe is provided herein. The canoe generally consists of a shell, e.g., of fiberglass-reinforced plastic e.g., polyester resin with an extensive internal reinforcement of plastic foam, e.g., epoxy foam in the bottom of the canoe, buttressed by an additional but simple lightweight metal framework e.g., steel or aluminum at the mounting flanges and in the upper portion of the canoe interior and preferably bonded thereto by the thermosetting polyester resin. This sonar dome canoe achieves the conflicting requirements for light weight and robustness in a canoe used in a slamming environment.

13 Claims, 4 Drawing Figures

SLAMMING-RESISTANT SONAR DOME CANOE

BACKGROUND OF THE INVENTION

1. Field of the Invention

This invention relates to a slamming-resistant sonar dome canoe, and to a method for its manufacture.

2. Description of the Prior Art

Underwater SONAR (abbreviated from "Sound Navigation and Ranging") is finding ever-increasing use in the fields of navigation, mapping, depth finding, fish finding, and detection of wrecks and, militarily, for the detection of enemy vessels. There are generally two types of SONAR as used by surface vessels, namely: hull-mounted systems, wherein an underwater sound transducer or array is attached to the hull of the vessel; and variable depth systems, wherein an underwater sound transducer or array is mounted in a body towed by the vessel. The present invention is concerned with hull-mounted SONAR systems.

In the case of hull-mounted SONAR, it is usual to house the transducer or array of transducers in a streamlined, acoustically-transparent housing attached to the surface vessel. The purpose of this streamlined housing is to minimize the interfering effects of water flow noise around and adjacent to the transducer or array as the vessel moves through the water. In addition to streamlining the housing around the sides of the transducer, it is also usual to add a streamlined cover beneath. This cover is colloquilly known as a "canoe" because of the general resemblance in shape to that type of craft.

Mounting of the SONAR unit in a forward location (even precisely right at the bow) of the vessel is commonplace. Because it is sometimes necessary for divers to detech the canoe underwater for access to, and for servicing of, the underwater transducer or array, it is desirable that the canoe be light and easily handled.

In high seal states, it is usual that the stem of the vessel will alternately emerge from, then submerge again into, the sea. This gives rise to high momentary pressures, called "slamming pressures", beneath the stem. These pressures are repetitive, and since they can reach several hundred pounds per square inch, can be destructive both to the vessel and to any appendages thereon. The canoes of forward and bow mounted SONAR are directly subjected to these pressures, and must therefore be made robust to withstand them.

The requirement for robustness is contradictory to the requirement for light weight. Various means have been used in the past to reconcile these conflicting requirements. These have included (but are not restricted to) the use of complicated steel reinforcing frameworks within an outer skin of glass fiber reinforced plastic. However, these solutions have not been entirely satisfactory due to their complexity and/or weight and did not adequately solve the total problem by meeting the conflicting requirements of robustness and lightweight.

Many patents have attempted to provide floating structures which were alleged to combine lightness with considerable strength and water-impermeability. Among them are:

(1) Canadian Pat. No. 567,360 issued Dec. 8, 1958 to Tanza Electric and Chemical Works, which taught the use of a plurality of plates forming the hull of a boat, the plates comprising water-impermeable solid plastic sheets enclosing a core of closed-cell cellular plastic material;

(2) Canadian Pat. No. 681,568 issued Mar. 3, 1964 to Dominion Rubber Company, which provided a boat made up of a laminate of a core of a cellular gum plastic material, a rigid sheet of solid gum plastic material united to each face of the core, and an outer protective adherent material film overlying the outer surface of the rigid sheets;

(3) Canadian Pat. No. 694,755 issued Sept. 22, 1964 to David Bloom, which provided a buoyant pontoon of foam plastic within which anchorage means were integrally implanted;

(4) Canadian Pat. No. 734,289 issued May 17, 1966 to Wesley K. Landes which taught the use of aircraft floats made up of a shell of glass fiber reinforced plastic material substantially completely filled with a buoyant closed-cell cellular material;

(5) Canadian Pat. No. 736,835 issued June 21, 1966 to Michael Sawchuk, which provided a surfboard construction consisting of hollow sections molded from a plastic material and filled with a buoyant cellular material;

(6) Canadian Pat. No. 817,100 issued July 8, 1969 to George A. Gust, which provided a watercraft formed of solid, homogenous polystyrene foam, provided with an elongated reinforcing member embedded in the body;

(7) Canadian Pat. No. 840,152 issued Apr. 28, 1970 to Leo M. Krenzler which provided a boat hull of an outer shell of stiff structural material and an inner web of flexible reversely contoured reinforcing material, and having its bilge and side areas filled with foamed plastic which also encases the inner web of reversely contoured reinforcing material;

and (8) Canadian Pat. No. 857,643 issued Dec. 8, 1970 to Walter Anderson, which provided a watercraft whose hull was made of glass fiber reinforced plastic material whose internal cavity was substantially filled with light flotation material.

Deficiencies of the Prior Art

None of these proposals provided a rigid structure of light weight and great strength which included both foamed plastic material and separate and distinct reinforcing frameworks.

SUMMARY OF THE INVENTION

Aims of the Invention

An object, therefore, of this invention is to provide a sonar dome canoe which is both light weight and robust to resist slamming damage.

Statements of Invention

By this invention, a canoe for sonar domes is provided comprising a lightweight, strong, formed shell; an internal, form-fitting, reinforcement of plastic foam in the bottom thereof; and a lightweight, metal, reinforcing framework in the upper portion thereof, secured thereto along the peripheral edges of the canoe.

Other Features of the Invention

By one feature of this invention, the shell is formed of fiberglass-reinforced plastic.

By another feature of this invention, the shell includes a stiffener web along the inside keel line.

By a further feature of this invention, the stiffener web is formed of steel, and is completely enclosed by the fiberglass reinforced plastic.

By yet another feature of this invention, the upper rim of the canoe is provided with an inwardly directed peripheral lip.

By still another feature of this invention, the framework is secured to inwardly directed, peripheral mounting flanges at the upper lip.

By another feature of this invention, the framework comprises a peripheral flange corresponding generally to the peripheral contour of the upper rim; a plurality of spaced-apart, downwardly depending gussets rigidly secured thereto; a plurality of transverse bars each connected, at one end, to an associated one of the gussets; a central longitudinal channel bar having the other end of the transverse bars integrally secured thereto; and a pair of upwardly extending gussets at each end of the channel bar.

By another feature of this invention, the framework is secured to the canoe only by means of securement of the peripheral flange to the peripheral lip.

By another feature of this invention, the plastic is foamed in situ.

By a further feature, the plastic is foamed in situ and encases the channel bar.

Thus, by this embodiment of this invention, the sonar dome canoe generally consists of a shell of fiberglass-reinforced plastic with an extensive internal reinforcement of plastic foam of substantially the same contour as, and disposed in, the bottom of the canoe, buttressed by an additional but simple lightweight metal framework at the mounting flanges and in the upper portion of the canoe interior. The plastic foam can be conveniently foamed in situ during manufacture, is very light weight, and adds a substantial amount of flexural strength to the shell of the canoe to resist the effects of high slamming pressures. This sonar dome canoe achieves the conflicting requirements for light weight and robustness in a sonar dome canoe used in a slamming environment.

BRIEF DESCRIPTION OF THE DRAWINGS

In the accompanying drawings.

DESCRIPTION OF PREFERRED EMBODIMENTS

Description of the Drawings

Figure 1:
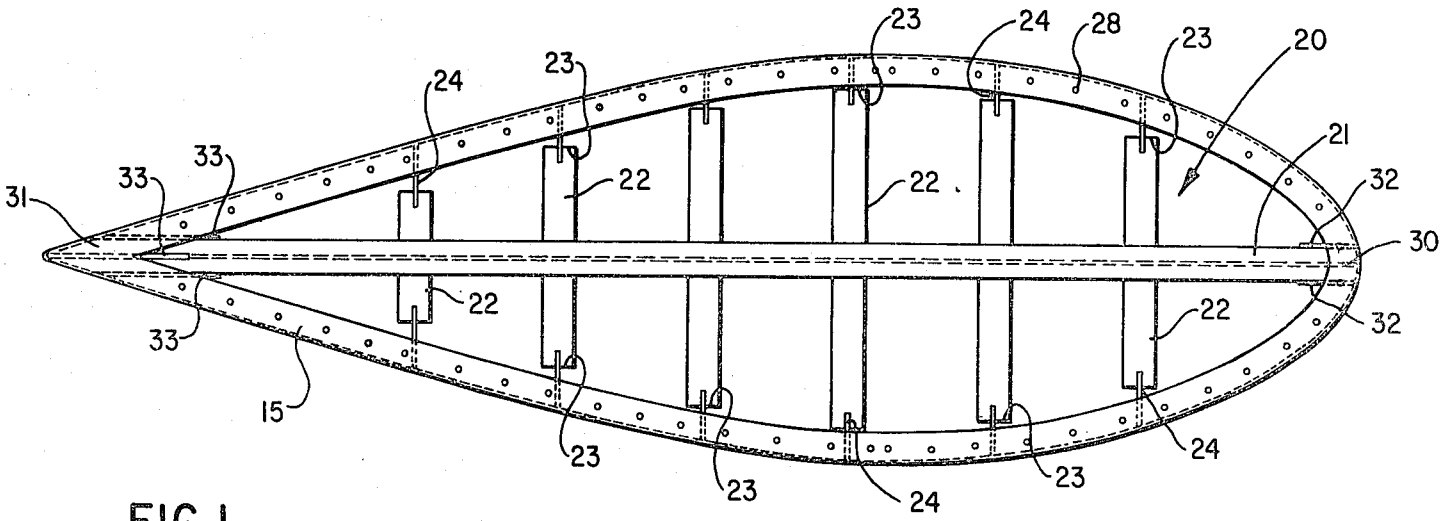
FIG. 1 is a top plan view of the sonar dome canoe of one embodiment of this invention.
Figure 2:
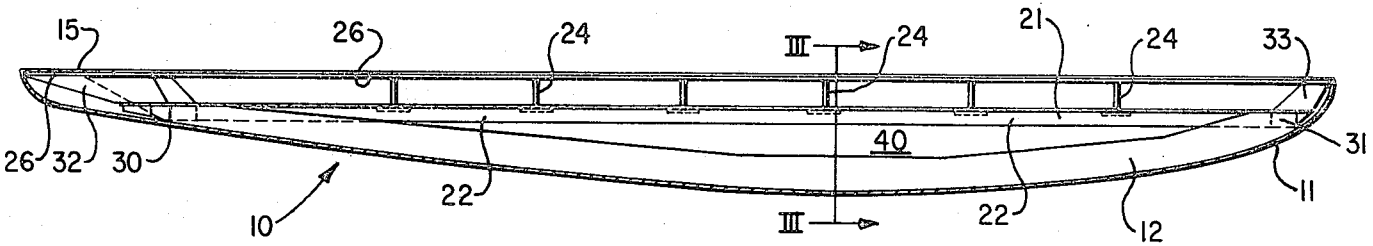
FIG. 2 is a central longitudinal section of the canoe of one embodiment of this invention.
Figure 4:
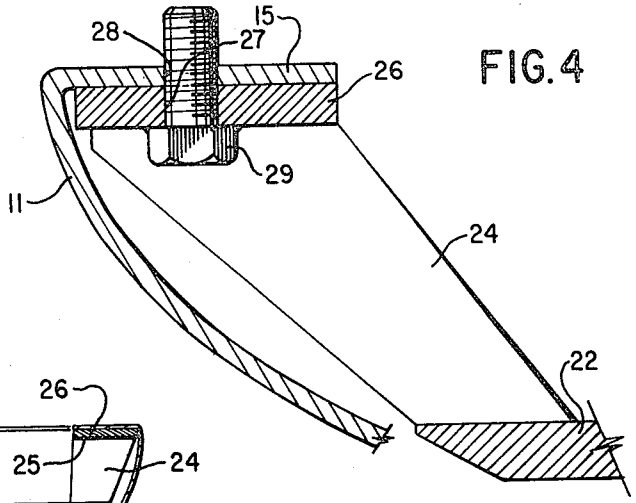
FIG. 4 is an enlarged detail showing the securement of the reinforcing framework to the canoe shell.
Figure 3:
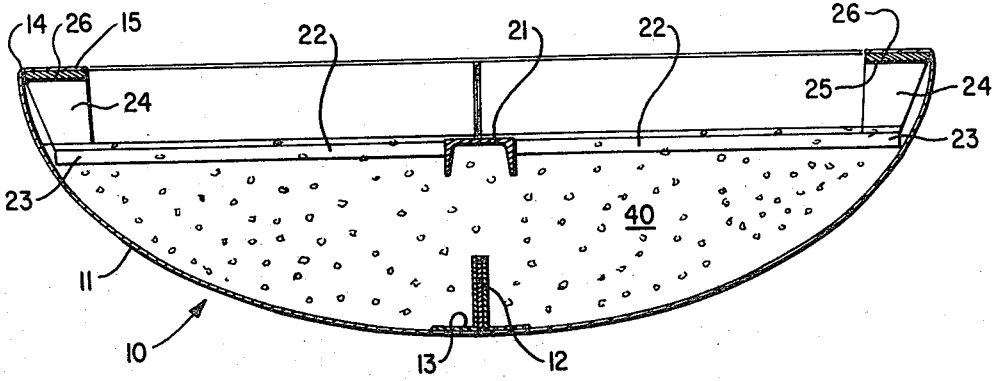
FIG. 3 is a full transverse section through the line III—III of FIG. 2.

Briefly, the canoe 10 includes a shell 11 formed of molded fiberglass reinforced resin and is provided with a steel stiffener web 12 along the inside keel line, which is completely enclosed by plastic resin 13 united to the shell 11. The upper rim 14 is provided with an inwardly directed peripheral lip 15, to aid in removal of the shell 11 from its mold (not shown), and also for a purpose to be described hereinafter. It is also desirable to provide a standard drain insert (not shown) in the molded shell 11.

The reinforcing framework 20 includes a longitudinally extending channel bar 21 of steel and a plurality of spaced-apart, transverse (athwartship) bars 22 (also of steel). The free ends 23 of each of the transverse bars 22 are each provided with an upwardly extending gusset 24, the upper end 25 of each gusset 24 being secured to a peripheral flange 26. The fore 30 and aft 31 ends of the channel bar 21 are each provided with gussets 32, 33 which extend between the channel bar 21, the keel stiffener web 12, and the lip 15 to form a rigid connection. The flange 26 is welded or otherwise secured to the inner face of the lip 15. The flange 26 is also provided with a plurality of apertures 27 aligned with apertures 28 in lip 15 by means of which the canoe 10 may be secured to the sonar dome (not shown), through means of bolts 29.

It will be seen, therefore, that the steel reinforcing framework 20 sits below the upper rim 14 of the canoe shell 11.

Disposed in the lower portion of the canoe shell 11 is a foamed plastic material 40. The foamed plastic 40 material extends over and surrounds the bars 21 and 22 of the steel reinforcing framework 20. The canoe is preferably loaded with foam such that the cannel bar 21 and the athwartship bars 22 are completely immersed. Access from the dome cavity through the foam to the drain insert and plug is also provided for.

Description of Construction of Embodiment of the Invention

In the construction of the sonar dome canoe of one embodiment of the invention, the outer shell 11 is formed as a whole unit laminated structure. The layup consists of layers of glass cloth and mat impregnated with a suitable thermosetting resin. Examples include polyester resins, epoxy resins, phenolic resins and melamine resins. The upper rim 14 is formed with a substantial lip 15 all the way around, thus providing good support for removal of the shell 11 from the mold (not shown). Throughout the length of the gentler curved part of the shell 11 along the inside keel line, a steel stiffener web 12 is laid, which is completely encapsulated with the glass fiber reinforced plastic. A standard drain insert (not shown) is also installed.

The reinforcing framework 20 is an all metal, e.g., steel, aluminum, magnesium, etc. structure comprising two halves which marry up at assembly into the shell 11. The main upper member is a flange 26 which extends practically all the way around the rim 14 of the canoe and is bonded to the peripheral lip by means of the thermosetting resin in the fiberglass shell 11 to sit underneath the lip 15 of the shell 11. It also provides a bolting surface by which the canoe 10 is secured to the dome (not shown). Protruding from the underside of the flange 26 is a series of gussets 24 to whose lower edges are attached bars 22 extending towards the center of the canoe. Following the installation of each half of the framework 20 into the shell 11, the bars 22 are each connected (as by welding) to a channel member 21 which runs fore and aft down the center of the canoe 10. The ends of the channel member 21 are connected to further gussets 32, 33 extended from the flange and also by gussets 32, 33 to the steel keel stiffener 12 in the bottom of the shell 11. Most of the connections between components of the frame are welded, including some of those made inside the shell. This feature is possible because the only part in very close proximity to the fiberglass reinforced plastic shell 11 is the flange 26. A considerable factor in time saving and relief of difficulty in obtaining the correct alignment of framework 20 to shell 11 is realized in this design since there is no contour match to be made.

Description of Preferred Constituents

A degree of support for the shell is provided by a flamed plastic, e.g. an epoxy foam, which is preferably foamed in situ. The material may be broadly characterized as a lightweight, closed cell, easy-to-use product. It may be used in a free air application and when cured displays good flexural and compressive strength properties. Other suitable foams include polyurethane foam, and foams formed from thermoplastic resins, e.g., polyvinylchloride, polystyrene, or expanded polystyrene, or hard rubber foams. A closed-cell cellular substance is preferred. The term "cellular substance" as used herein means one having a number of cells or voids enclosed by thin partitions more or less as an irregular honeycomb and is characterized by a high volume-to-weight ratio or low specific gravity. One example of a cellular material can be made from 60 parts polyvinylchloride, 40 parts diisocyanate and 15 parts of azo-isobutyric acid dinitrile.

Another example of a suitable cellular material is a mixture of a major proportion of a hard, plastic material (e.g. styrene-acrylonitrile resin, with or without polyvinyl chloride resin) and a minor proportion of a rubbery material compatible therewith (e.g. butadiene-acrylonitrile rubber, with or without small amounts of other rubbery materials, e.g. polybutadiene, butadiene-styrene rubber or natural rubber), and also containing curatives or vulcanizing agents, e.g. sulphur, preferably along with an accelerator, which act on the rubbery constituent and cause it to be converted by heat into a strong, solvent-resistant substance. The composition further includes a blowing agent, that is, a substance capable of turning into a gas or vapor, or generating a gas or vapor at elevated temperature, thus forming a large number of small pores or cells in the material. In this way the effective density is very much reduced, the product is thus rendered extremely buoyant. One specific density in the blown state is 10–30, e.g., 15 pounds per cubic foot. Any suitable blowing agent may be used.

A specific example of a suitable formulation is as follows:

| | Parts |
|---|---|
| Styrene-acrylonitrile resin | 70 |
| Butadiene-acrylonitrile rubber | 25 |
| Plasticizer | 5 |
| Anti-oxidant | 3.1 |
| Stearic acid | 1 |
| Zinc oxide | 3 |
| Benzothiazyl disulfide | 0.5 |
| Sulphur | 1.6 |
| Blowing agent | 15 |

Any suitable conventional plasticizer (e.g. the liquid butadiene-acrylonitrile copolymer sold under the Trade Mark "Hycar 1312") may be used, as may any suitable conventional anti-oxant (e.g. the diphenylamine-acetone condensation product known as "BLE"). Ny suitable conventional blowing agent (e.g. dinitroso pentamethylene tetramine) may be used.

Operation of Preferred Embodiment

The sonar dome canoe may thus broadly be described as comprising a shell or casing fabricated from high strength, lightweight synthetic material, for example, hardenable synthetic resin, e.g., a thermosetting type resin, laminantly impregnated with glass cloth or glass fibers, with an interior filling formed in situ of closed cell cellular material, e.g. polyurethane foam, expanded polystyrene or the like.

In the fabrication of the sonar dome canoe, using polystyrene, the upper framework lattic is secured in place and the plastic in the form of the usual polystyrene plastic beads is blown into the molded sonar dome canoe shell. When the cavity is loaded with the required amount of beads, steam is introduced in the usual manner, causing expansion and fusion of the beads into a unitary mass. The lower portion of the metal framework lattice is thereby molded within the unitary mass of foamed or expanded plastic and is thereby tightly held in place. There is some degree of adhesion of this plastic mass to the framework, which assists in the reinforcement and stiffening of the plastic.

SUMMARY

From the foregoing description, one skilled in the art can easily ascertain the essential characteristics of this invention, and without departing from the spirit and scope thereof, can make various changes and modifications of the invention to adapt it to various usuages and conditions. Consequently, such changes and modifications are properly, equitably, and "intended" to be, within the full range of equivalence of the following claims.

I claim:

1. A canoe for sonar domes comprising: a light-weight, strong, formed shell; an internal form-fitting reinforcement of plastic foam in the bottom thereof; and a light-weight, metal, reinforcing framework in the upper portion thereof, secured thereto along the peripheral edges of the canoe.

2. The canoe of claim 1 wherein said shell is formed of fiberglass-reinforced thermosetting plastics material.

3. The canoe of claim 2 wherein said thermosetting plastics material is a polyester resin.

4. The canoe of claim 2 wherein said shell includes a stiffener web along the inside keel line.

5. The canoe of claim 4 wherein said stiffener web is formed of steel, and is substantially completely enclosed by said fiberglass-reinforced plastic.

6. The canoe of claim 4 wherein said stiffener web is formed of aluminum, and is substantially completely enclosed by said fiberglass reinforced plastic.

7. The canoe of claim 2 wherein the upper rim of the canoe is provided with an inwardly directed peripheral lip.

8. The canoe of claim 7 wherein said framework is bonded to said peripheral lip by means of said thermosetting material.

9. The canoe of claim 7 wherein said framework is provided with inwardly directed, peripheral mounting flanges at said upper rim.

10. The canoe of claim 9 wherein said framework comprises a peripheral contour of said upper rim; a plurality of spaced-apart, downwardly depending gussets rigidly secured thereto; a plurality of transverse bars each connected, at one end, to an associated one of said gussets; a central longitudinal channel bar having the other end of said transverse bars integrally secured thereto; and a pair of upwardly extending gussets at each end of said channel bar.

11. The canoe of claim 9 wherein said framework is secured to said canoe only by means of securement of said peripheral flange to said upper rim.

12. The canoe of claim 1 wherein said plastic foam in foamed in situ.

13. The canoe of claim 10 wherein said plastic foam is foamed in situ and encases said channel bar.

* * * * *